US012492887B2

(12) United States Patent
Spilotro et al.

(10) Patent No.: US 12,492,887 B2
(45) Date of Patent: Dec. 9, 2025

(54) MINIATURE ELECTRONIC SAFE ARM DEVICE

(71) Applicant: Breault Research Organization, Inc., Tucson, AZ (US)

(72) Inventors: John J. Spilotro, Tucson, AZ (US); John D. Willett, Tucson, AZ (US)

(73) Assignee: Breault Research Organization, Inc., Tucson, AZ (US)

( * ) Notice: Subject to any disclaimer, the term of this patent is extended or adjusted under 35 U.S.C. 154(b) by 9 days.

(21) Appl. No.: 18/699,692

(22) PCT Filed: Oct. 13, 2022

(86) PCT No.: PCT/US2022/046580

§ 371 (c)(1),
(2) Date: Apr. 9, 2024

(87) PCT Pub. No.: WO2023/167712

PCT Pub. Date: Sep. 7, 2023

(65) Prior Publication Data

US 2024/0418489 A1 Dec. 19, 2024

Related U.S. Application Data

(60) Provisional application No. 63/256,324, filed on Oct. 15, 2021.

(51) Int. Cl.
*F42C 15/40* (2006.01)
*F42C 19/02* (2006.01)
(Continued)

(52) U.S. Cl.
CPC ..... *F42C 15/40* (2013.01); *F42C 19/02* (2013.01); *F42C 19/06* (2013.01); *F42C 19/0838* (2013.01); *F42C 19/12* (2013.01)

(58) Field of Classification Search
CPC ..... F42C 15/40; F42C 19/02; F42C 19/06; F42C 19/12; F42C 19/0838; B64C 29/02; B64U 10/20
(Continued)

(56) References Cited

U.S. PATENT DOCUMENTS 5,325,784 A * 7/1994 Bai ..... F42C 19/02 102/293
5,939,662 A * 8/1999 Bootes ..... F42B 39/20 102/293
(Continued)

OTHER PUBLICATIONS

Oct. 2, 2023—(WO) International Search Report and Written Opinion—App PCT/US2022/046580.

*Primary Examiner* — James S Bergin
(74) *Attorney, Agent, or Firm* — Banner & Witcoff, Ltd.

(57) ABSTRACT

Disclosed is a miniature electronic safe arm device (MESAD) kit. The MESAD kit comprises a munition adapter. a high explosive booster charge. a low energy exploding foil initiator (LEEFI) detonator, and a warhead initiation module. The munition adapter comprises a male threaded portion configured to thread into a female threaded portion at an end of a munition shell. The MESAD kit enables conversion of existing stockpiles of inventoried legacy munitions in the field. into UAS payloads by replacing legacy mechanical and electro-mechanical fuzes used on these legacy munitions with a MESAD assembly.

22 Claims, 9 Drawing Sheets

(51) Int. Cl.

| | |
|---|---|
| ***F42C 19/06*** | (2006.01) |
| ***F42C 19/08*** | (2006.01) |
| ***F42C 19/12*** | (2006.01) |

(58) Field of Classification Search
USPC ..... 102/202.1, 202.5, 221, 262
See application file for complete search history.

(56) References Cited

U.S. PATENT DOCUMENTS

| | | | | |
|---|---|---|---|---|
| 6,523,477 | B1 * | 2/2003 | Brooks | F42B 39/20 102/517 |
| 7,971,533 | B1 * | 7/2011 | Berlin | F42C 19/02 102/275.9 |
| 9,273,939 | B2 * | 3/2016 | Ackermann | F42C 15/00 |
| 2009/0260534 | A1 | 10/2009 | Soto et al. | |
| 2011/0162548 | A1 | 7/2011 | Berlin et al. | |
| 2015/0285606 | A1 | 10/2015 | DeVries et al. | |
| 2015/0345915 | A1 | 12/2015 | Ackermann | |
| 2021/0284329 | A1 | 9/2021 | Bernard | |

* cited by examiner

MINIATURE ELECTRONIC SAFE ARM DEVICE

CROSS-REFERENCE TO RELATED APPLICATIONS

This application is a U.S. National Stage application under 35 U.S.C. § 371 of International Application PCT/US2022/046580 (published as WO/2023/167712 A2), filed Oct. 13, 2022, which claims the benefit of priority to U.S. provisional patent application No. 63/256,324, filed on Oct. 15, 2021, and entitled "Miniature Electronic Safe Arm Device". Benefit of the filing date of these prior applications is hereby claimed. Each of these prior applications is hereby incorporated by reference in its entirety.

TECHNICAL FIELD

The present invention relates to a fuze system having an electronic safe and arm device.

BACKGROUND

Stockpiles of existing munitions typically have legacy mechanical and electro-mechanical fuzes. Due to these conventional legacy mechanical and electro-mechanical fuzes, existing munitions cannot be used in a manner other than their designed use. For example, conventional mortar munitions have conventional mechanical or electro-mechanical fuze systems. These conventional mechanical or electro-mechanical fuze systems require the mortar munition shell be dropped into an opening of a mortar tube positioned at a particular angle in relation to the ground. When an end of the mortar munition shell hits a firing pin, a propelling charge ignites and the mortar shell flies out of the opening of the mortar tube in the direction of an intended target. Conventional fuzes are not designed or qualified for re-purposing of existing munitions for use as Unmanned Aerial System (UAS) loitering munitions (also known as a suicide drone, weapons system category in which the munition loiters around a target area, searches for targets, and attacks once a target is located).

There are high costs associated with development and qualification of new munitions, e.g., loitering munitions for use with an Unmanned Aerial System (UAS). For example, with development and qualification of new munitions, e.g., loitering munitions for use with an Unmanned Aerial System (UAS) typically takes 2-3 years at a cost of about $2-3 million.

It would be beneficial to have a device that is able to convert existing stockpiles of existing munitions, e.g., mortar munitions, for use as re-purposed munitions, e.g., as Unmanned Aerial System (UAS) loitering munitions.

SUMMARY

Briefly, the present invention is a system comprising a miniature electronic safe arm device (MESAD) kit. The MESAD kit comprises a munition adapter, a high explosive booster charge, a low energy exploding foil initiator (LEEFI) detonator, and a warhead initiation module. The munition adapter comprises a male threaded portion configured to thread into a female threaded portion at an end of a munition shell.

In an embodiment, the adapter is configured to facilitate re-purposing of an existing munition. In an embodiment, the munition adapter comprises a housing, wherein the housing defines a channel configured to receive the high explosive booster charge. In an embodiment, the high explosive booster defines an opening configured to receive at least a portion of the LEEFI detonator.

In an embodiment, the warhead initiation module comprises a LEEFI detonator socket configured to receive a portion of the LEEFI detonator not placed in the opening defined by the high explosive booster.

In an embodiment, the warhead initiation module comprises a high voltage fireset and a safe arm module (SAM). In an embodiment, the warhead initiation module comprises socket configured to receive a connector cable. In an embodiment, the MESAD kit includes the connector cable. In an embodiment, the connector cable is configured to provide electrical power and communications between a mission computer and the warhead initiation module.

It is an object, feature an aspect of the invention to provide a fuze kit that enables conversion of existing stockpiles of inventoried legacy munitions in the field, into UAS payloads by replacing legacy mechanical and electro-mechanical fuzes used on these legacy munitions with a MESAD assembly.

It is an object, feature and aspect of the invention to provide a MESAD kit wherein the components of the MESAD kit can be readily assembled into a MESAD assembly.

These and other objects, features, aspects and advantages of the invention are set forth in the detailed description that follows.

BRIEF DESCRIPTION OF THE DRAWINGS

In the following detailed description, reference is made to the following Figures.

DETAILED DESCRIPTION

Figure 1:
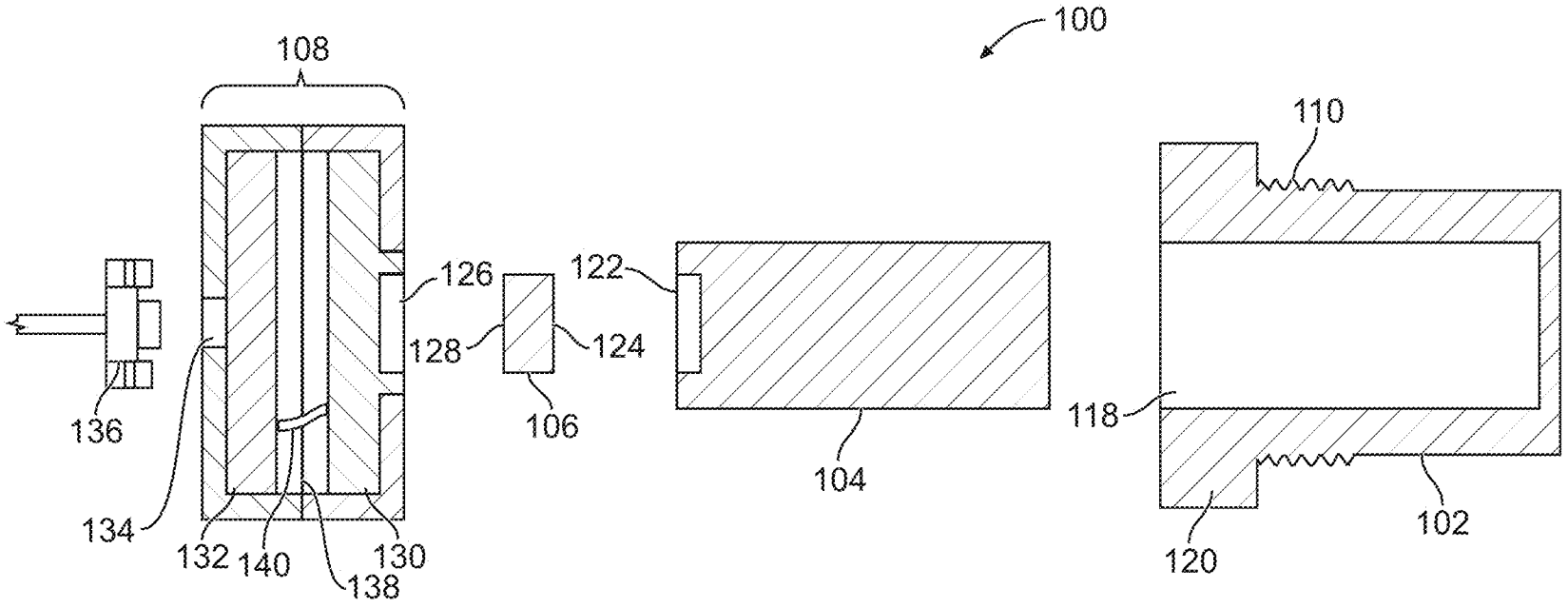
FIG. 1 is an exploded cutaway side view of an embodiment of a MESAD kit in accordance with aspects of the invention.

Aspects of the invention are depicted in FIG. 1 through FIG. 6D and FIG. 8. In reference to FIG. 1 and FIG. 2, miniature electronic safe arm device (MESAD) kit 100 comprises munition adapter 102, high explosive booster charge 104, low energy exploding foil initiator (LEEFI) detonator 106, and warhead initiation module 108. Munition adapter 102 comprises male threaded portion 110 configured to thread into a female threaded portion 112 at end 114 of munition shell 116. In an embodiment, high explosive booster charge 104 may be a polymer bonded explosive (PBNX), e.g., PBNX-5.

Figure 2:
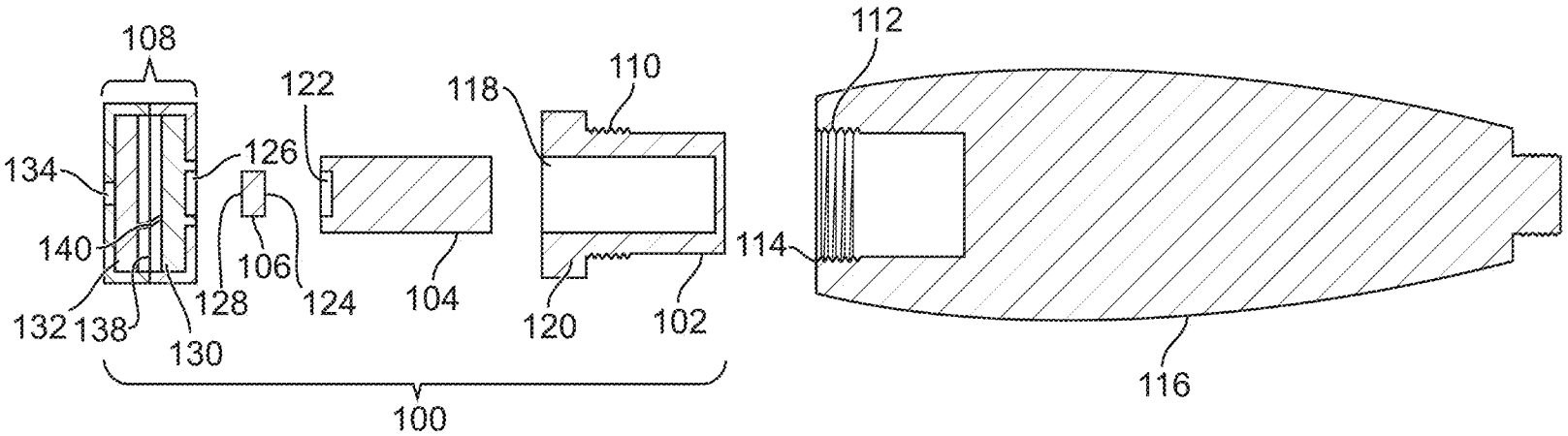
FIG. 2 is an exploded cutaway side view of the embodiment shown in FIG. 1 in relation to a mortar munition in accordance with aspects of the invention.

As shown in FIG. 1 and FIG. 2, munition adapter 102 is configured to facilitate re-purposing of an existing munition. As shown in FIG. 1 and FIG. 2, munition adapter 102 comprises channel 118 defined by housing 120. Channel 118 is configured to receive high explosive booster charge 104. High explosive booster charge 104 defines opening 122. Opening 122 is configured to receive at least a portion 124 of LEEFI detonator 106.

Warhead initiation module 108 comprises a LEEFI detonator socket 126. LEEFI detonator socket 126 is configured to receive portion 128 of LEEFI detonator not placed in opening 122 defined by high explosive booster charge 104.

Warhead initiation module 108 comprises high voltage fireset 130 and safe arm module (SAM) 132. Warhead initiation module 108 comprises socket 134 configured to receive connector cable 136 (shown only in FIG. 1). In an embodiment, MESAD kit 100 includes connector cable 136. In an embodiment, connector cable 136 is configured to provide electrical power and communications between a mission computer (not shown in FIG. 1, FIG. 2, or FIG. 3) and warhead initiation module 108. Optional partition 138 is between SAM 132 and high voltage fireset 130. Cable 140 electronically connects SAM 132 and high voltage fireset 130. When optional partition 138 is present, cable 140 extends through an opening defined by optional partition 138.

Figure 3:
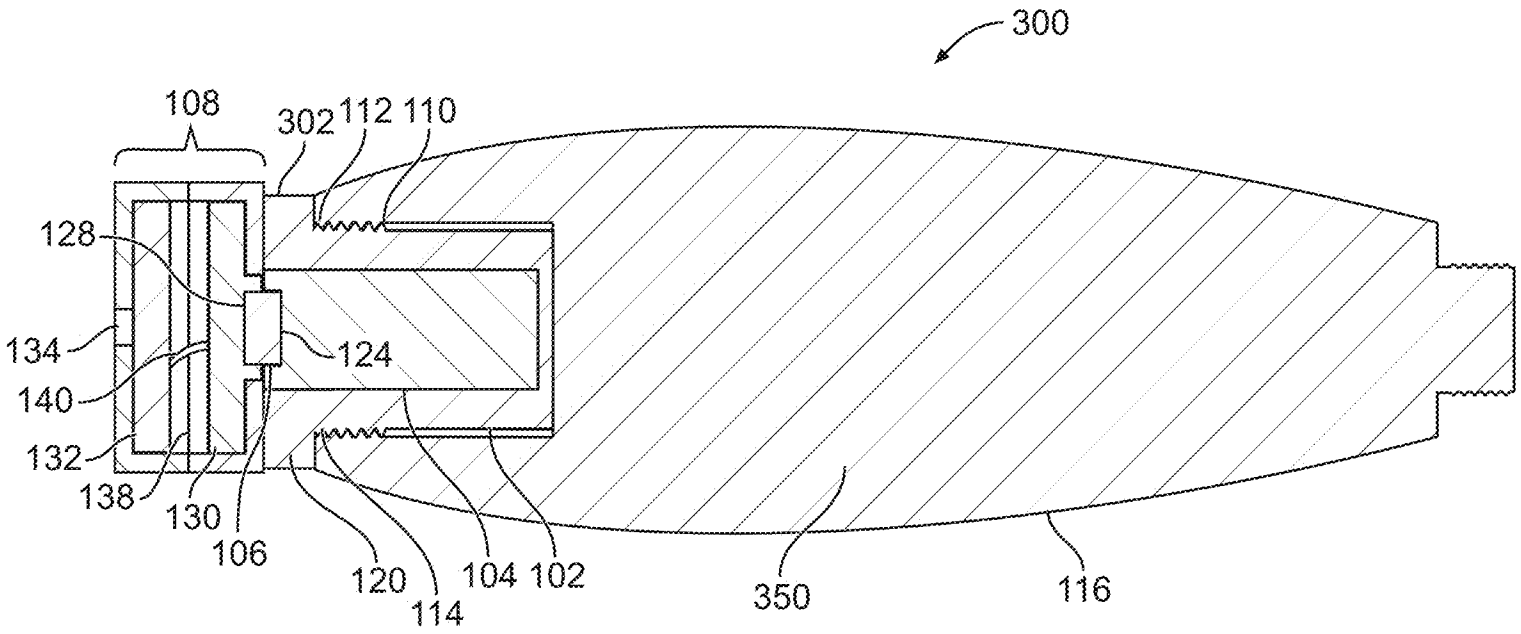
FIG. 3 is a cutaway side view of an assembly of an embodiment in accordance with aspects of the invention.

FIG. 3 is a cutaway side view of an embodiment in accordance with aspects of the invention. As shown in FIG. 3, assembly 300 comprises MESAD 302, which is MESAD kit 100 as assembled. Assembly 300 further comprises munition shell 116, which houses munition 350. As shown in FIG. 3, male threaded portion 110 is threaded into a female threaded portion 112 at end 114 of munition shell 116. In an embodiment, the MESAD comprises booster materials selected from the group consisting of MIL-STD-1316 and MIL-STD-2105 compliant booster materials.

Figure 4:
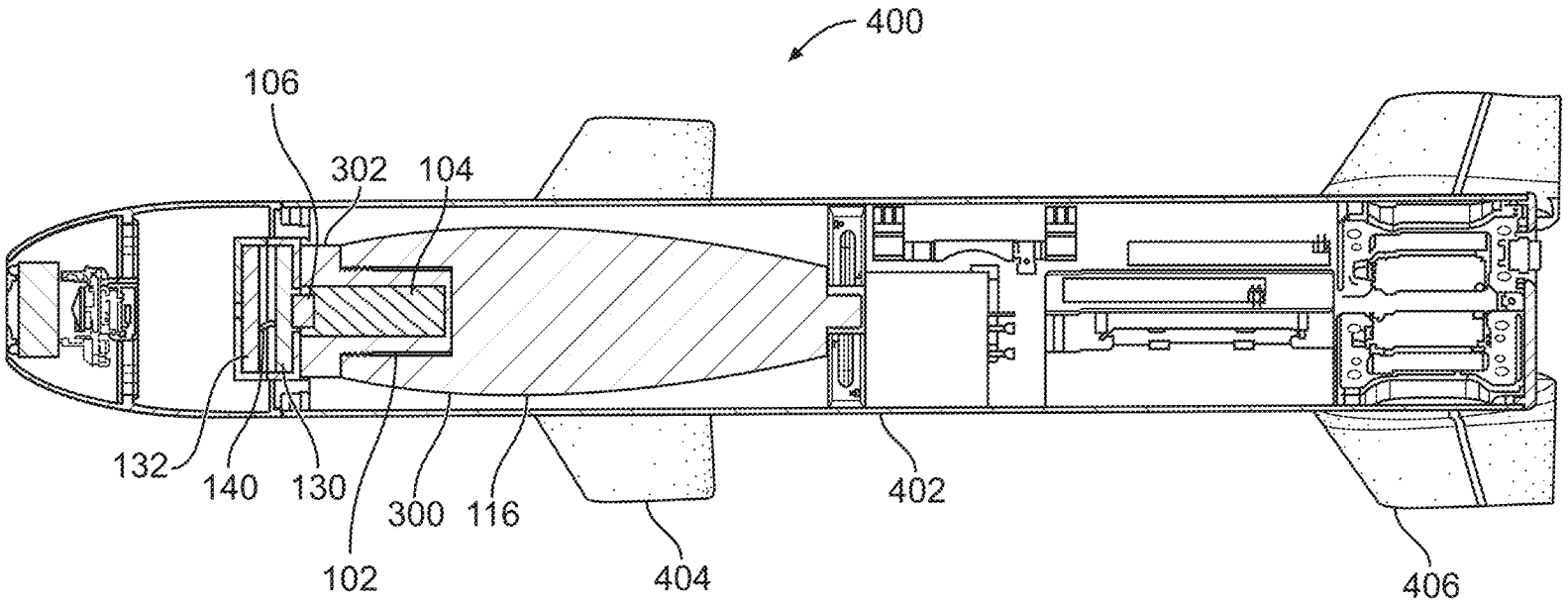
FIG. 4 is a cutaway side view of an embodiment in accordance with aspects of the invention, wherein the MESAD is installed in an aerial munition.

FIG. 4 is a cutaway side view of an embodiment in accordance with aspects of the invention. As shown in FIG. 4, loitering munition system 400 comprises assembly 300 depicted in FIG. 3. Loitering munition system 400 further comprises a glider 402 having forward fins 404 and rear fins 406. As previously noted, cable 140 electronically connects SAM 132 and high voltage fireset. Cable 140 is between circuit cards of SAM 132 and high voltage fireset 130. Cable 140 may be further apart with other distributed MESAD system variants with multiple firesets, multiple cables, and WIMs.

Figure 5:
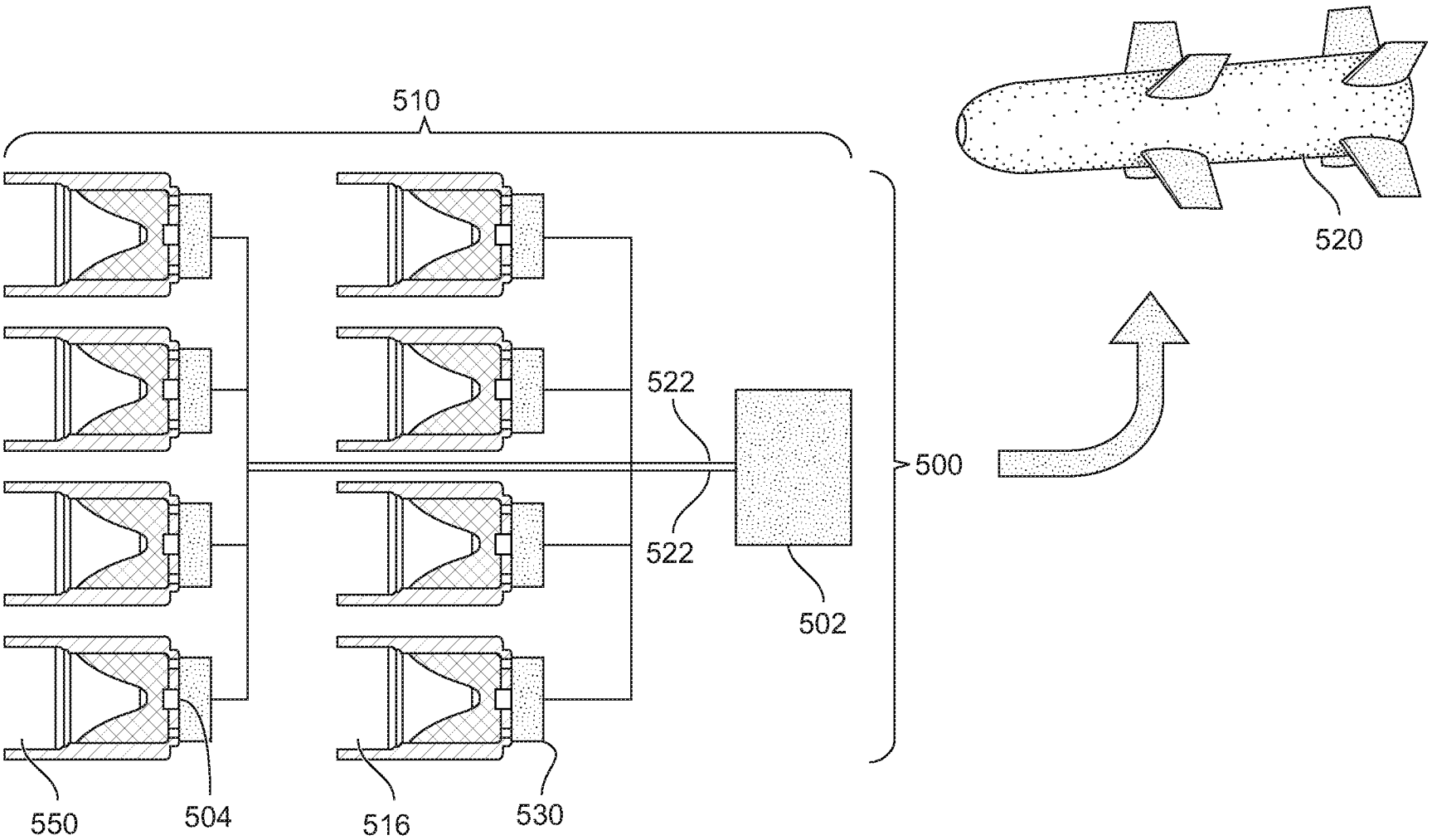
FIG. 5 depicts an embodiment in accordance with aspects the invention, wherein MESAD architecture supports simultaneous initiation of multiple firesets.

FIG. 5 depicts an embodiment in accordance with aspects the invention, wherein MESAD architecture 510 supports simultaneous initiation of multiple firesets. As shown in FIG. 5, miniaturized strike payload 500 comprises safe arm module 502. Safe arm module 502 is electronically connected by cables 522 to a plurality of high voltage fireset and LEEFI detonator combinations 530, which in turn are connected to a plurality of munition shells 516 and high explosive booster charges 504. Thus, in the embodiment shown in FIG. 5, safe arm module 502 is a single safe arm module (SAM) electronically connected to multiple firesets. Cables 522 may be the same as or similar to cable 140 shown in FIGS. 1-4. In an embodiment, high explosive booster charges 504 may be a polymer bonded explosive (PBNX), e.g., PBNX-5. Munition shells 516 house munitions 550. Munitions 550 may be submunitions, e.g., M80 submunitions of existing inventory. As shown in FIG. 5, the MESAD architecture 510 comprises at least eight (8) high voltage fireset and LEEFI detonator combinations 530, which in turn are connected to at least eight (8) munition shells 516 and high explosive booster charges 504. Miniaturized strike payload 500 may be placed in miniaturized strike precision glide munition 520. Other than a plurality of high voltage fireset and LEEFI detonator combinations 530 connected to a corresponding plurality of munition shells, miniaturized strike precision glide munition 520 may be the same as or similar to loitering munition system 400 depicted in FIG. 4.

Figure 6A:
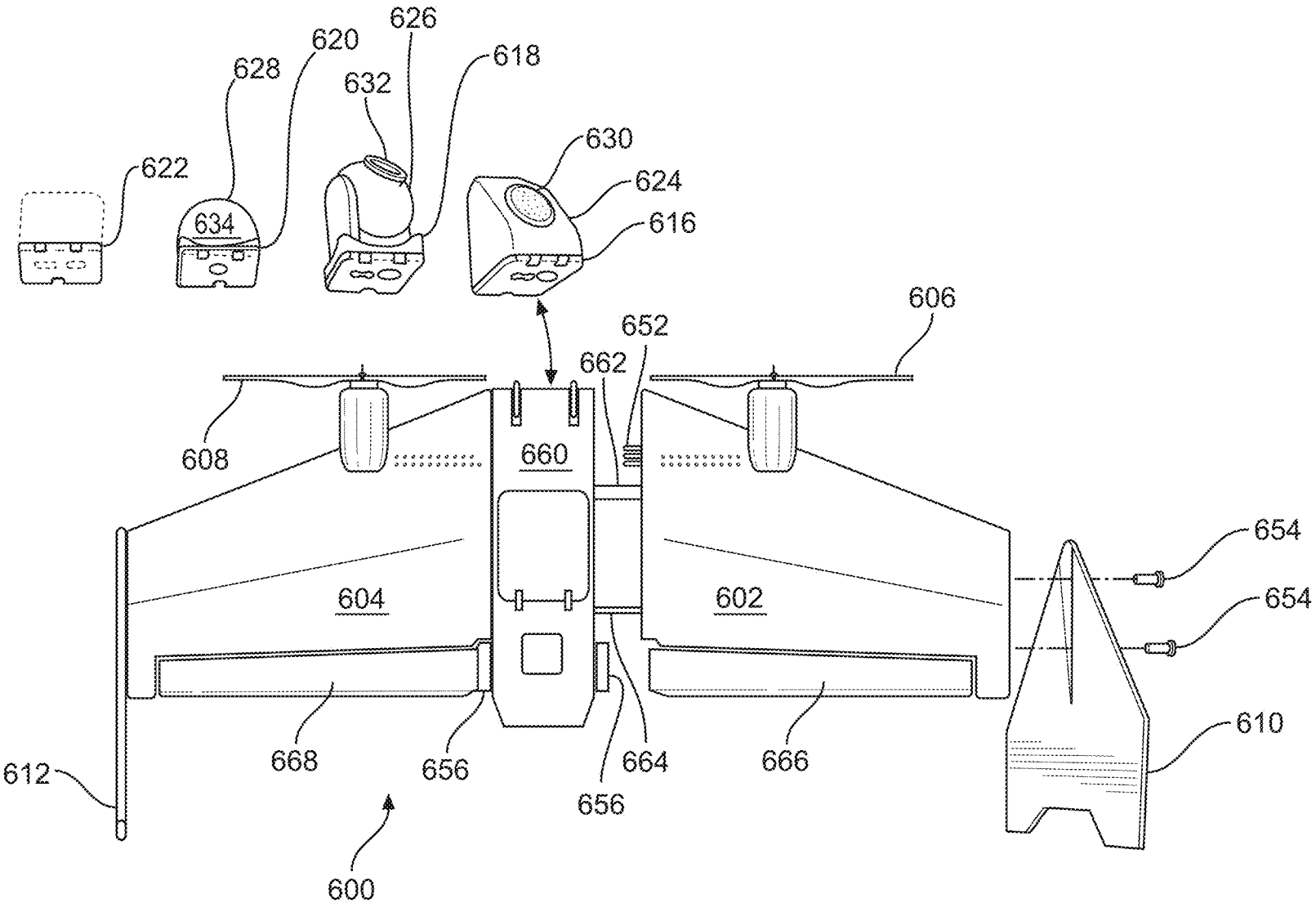
FIG. 6A depicts a vertical take-off landing (VTOL) loitering munition kit in accordance with aspects of the invention.

FIG. 6A depicts vertical take-off landing (VTOL) loitering munition kit 600 in accordance with aspects of the invention. VTOL loitering munition kit 600 comprises wings 602 and 604, propellers 606 and 608, upright fins 610 and 612, and body 660. VTOL loitering munition kit 600 further comprises at least one connection plate, such as connection plate 616, 618, 620, and/or 622. Body 660 is configured to connect to at least one connection plate 616, 618, 620, and 622. This construction allows for easy connection swap of a wide variety of payloads to body 514. In an embodiment, each connection plate 616, 618, 620, and 622 is configured to connect to at least one of a variety of payload housings, such as exemplary payload housings 624, 626, and 628. Each of payload housings 624, 626, and 628 may comprise an assembled MESAD as disclosed herein (see e.g., assembled MESAD 302 shown in FIG. 3). Alternatively, body 660 may comprise an assembled MESAD as disclosed herein. An either case, VTOL loitering munitions kit comprises a MESAD, either assembled or as a MESAD kit. Payload housing 624 is configured to contain or receive a munition 630. Payload housing 626 is configured to contain or receive munition 632. Payload housing 628 is configured to contain or receive munition 634 inside payload housing 628. An exemplary munition 630, munition 632, and/or munition 634 is a grenade, such as an M67 hand grenade. As assembled, the assembled MESAD and munition form an assembled MESAD and munition combination.

Connection of the assembly components of VTOL loitering munition kit 600, e.g., connection between wings 602 and 604 and body 660, may comprise electrical connectors 652, e.g., each electrical connector 652 comprising blind mate connectors, such as single three pin blind mate connectors. Electrical connectors 652 are configured to provide electrical power to propellers 606 and 608. FIG. 6A shows electrical connector 652 configured to provide electrical power to propeller 606. There is also an electrical connector (not shown in FIG. 6A) that is configured to provide electrical power to propeller 608. In an embodiment, male pins of electrical connector 652 may be configured to be inserted into a corresponding three-hole female socket (not shown in FIG. 6A) of body 660. In an embodiment, electrical connector 652 may have a non-conductive ring (not shown in FIG. 6A), e.g., a plastic ring, around the male pins, wherein the non-conductive ring is configured to mate with a corresponding female ring opening of a corresponding three-hole female socket housed within body 660. In an alternative embodiment, male pins of electrical connector 652 may be housed within body 660, and a corresponding three-hole female socket may be on wing 602 or wing 604. Body 660 may also be referred to as a fuselage. A power source (not shown in FIG. 6A) may be a battery housed within body 660. Connection of wings 602 and 604 to body 660, may comprise non-conductive connectors 662 and 664 that may snap into fitting openings (not shown in FIG. 6A) defined by body 660 and/or wings 602 and 604. Connection of other assembly components, e.g., upright fins 610 and 612 to respective wings 602 and 604, may comprise a single snap together assembly, e.g., with fasteners 654. VTOL loitering munition kit 600 may comprise servos 656 mounted to body 660. Servos 656 are configured to rotate and move elevator/aileron combinations, referred to herein as elevons 666 and 668. Elevons 666 and 668 may be operated to provide to pitch and/or roll of VTOL loitering munition kit 600, when assembled.

Figure 6C:
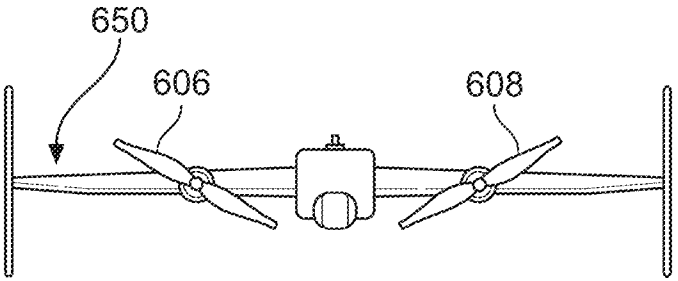
FIG. 6C is a top view of the VTOL loitering munition assembly shown in FIG. 6B.
Figure 6D:
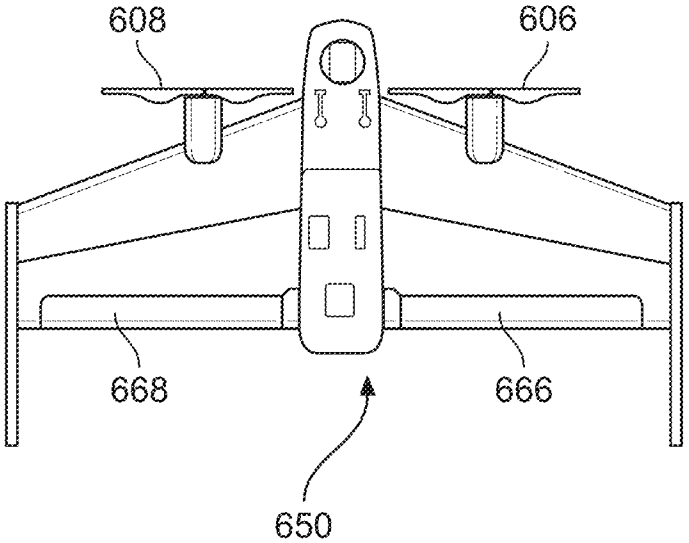
FIG. 6D is a front side view of the VTOL loitering munition assembly shown in FIG. 6B.
Figure 6B:
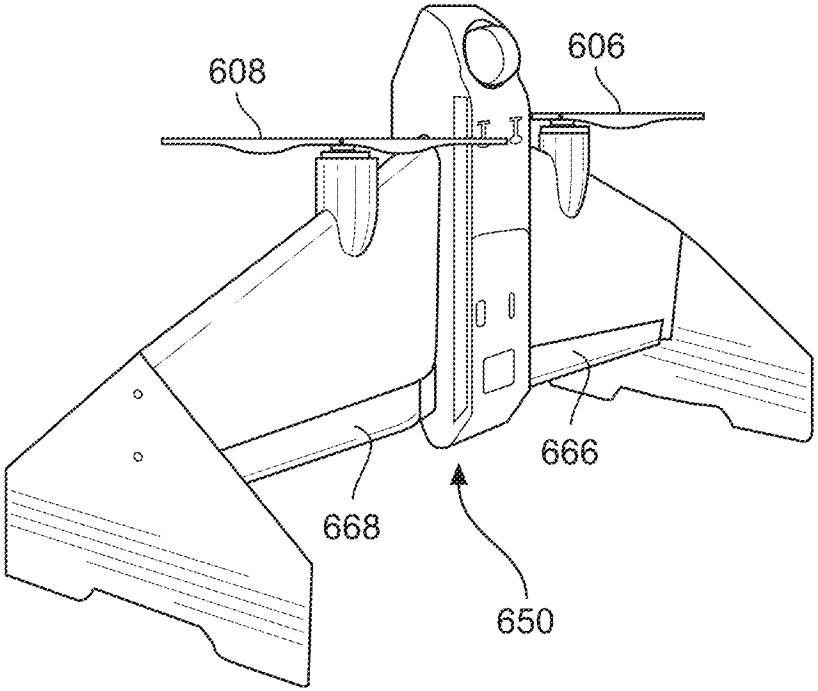
FIG. 6B is a perspective view of the VTOL loitering munition assembly of the VTOL kit shown in FIG. 6A as assembled.

FIG. 6B is a perspective view of the VTOL loitering munition assembly 650 of the VTOL loitering munitions kit 600 shown in FIG. 6A, as assembled. Elevons 666 and 668 may be operated to provide airborne pitch and/or roll movement of VTOL loitering munition assembly 650 when airborne. VTOL loitering munition assembly 650 may have a width of about three (3) feet from the outer face of upright fins 610 and the outer face of upright fin 612, and a height of about of about two (2) feet from the propellers to ground level when the VTOL loitering munition assembly 650 is vertically placed on the ground and propellers 606 and 608 are upright.

VTOL loitering munition assembly 650 may be operated to loiter and deliver a munition to a target site and detonate, or return to a safe site wherein it can be re-fueled or re-charged so it has power for another mission. The munition payload of VTOL loitering munition assembly 650 may also be changed out at the safe site.

FIG. 6C is a top view of the VTOL loitering munition assembly 650 shown in FIG. 6B.

FIG. 6D is a front side view of the VTOL loitering munition assembly 650 shown in FIG. 6B.

Figure 7:
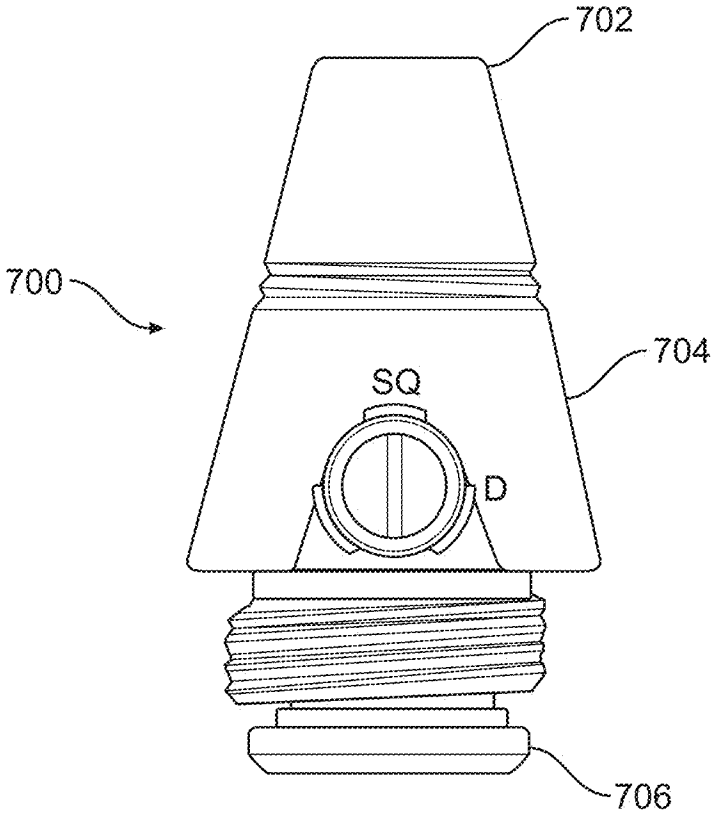
FIG. 7 (PRIOR ART)
FIG. 7 depicts a prior art fuze for a mortar munition.

FIG. 7 depicts a prior art fuze 700 designed for a mortar munition. An example of a prior art fuze is the American M935, a point detonating, super quick (PDSQ) or optional delay mortar fuze. The delayed arming mechanism allows the mortar to reach a safe distance from the mortar crew and to clear foliage at the mortar site before it is fully armed. The fuze is pre-set during manufacture to explode on impact, setting bolt at SQ. When set to D (for delay), the mortar will explode approximately 0.05 seconds after impact, thus allowing it to penetrate overhead cover. The fuze comprises three main components: a nose 702, a body 704, and magazine 706. At the pointed impacting end of the nose is the firing pin head, which connects to the firing pin. Body 704 contains a striker (not shown) for initiating the delayed arming mechanism. Until prior art fuze 700 becomes armed on firing, the firing pin head is retained by two set back locks consisting of two setback pins, two springs and two steel balls.

The fuze system disclosed herein enables users to convert existing stockpiles of inventoried munitions in the field into UAS payloads be replacing legacy mechanical fuzes used on these munitions, such as the prior art fuze shown in FIG. 7.

Figure 8:
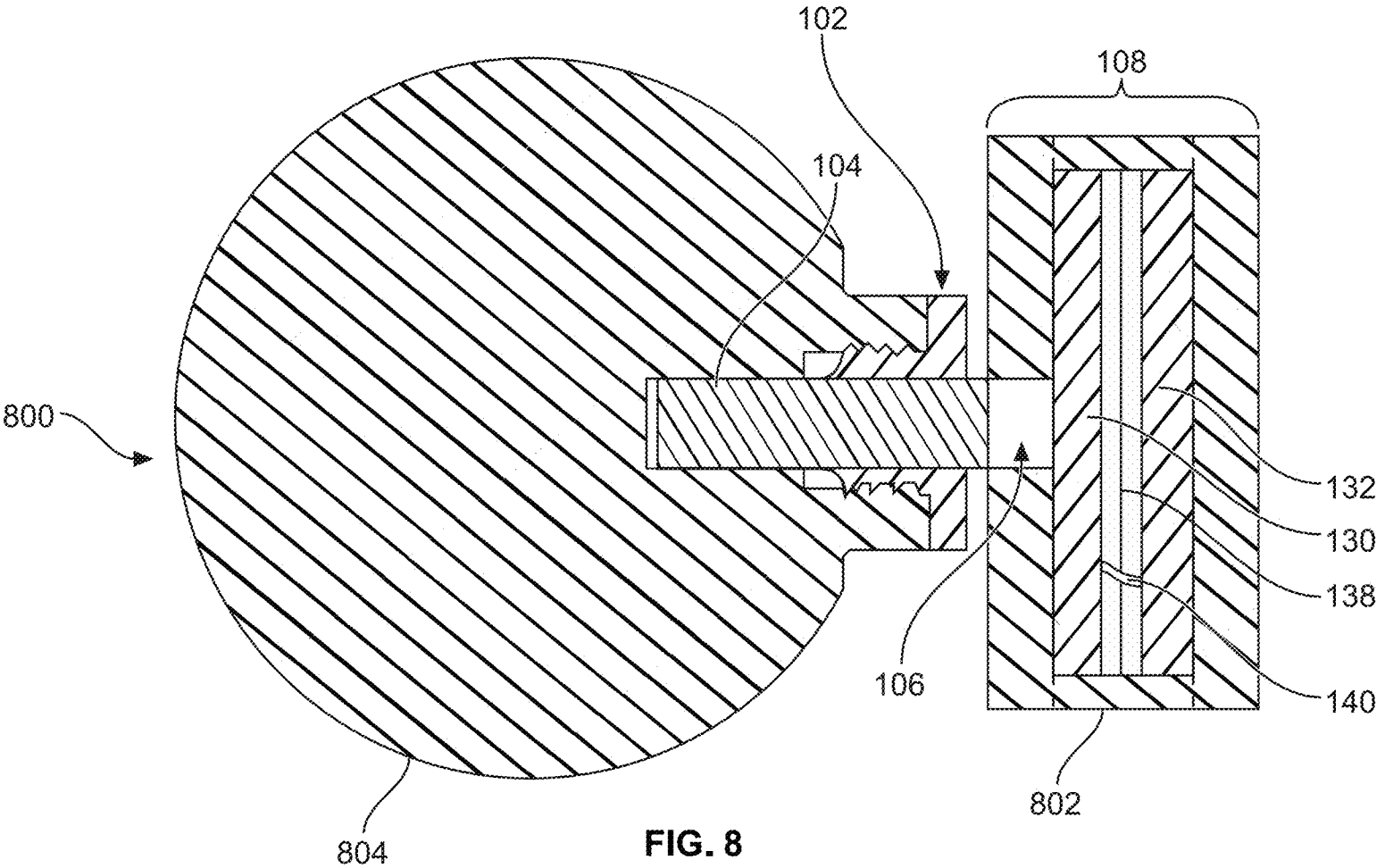
FIG. 8 is a cutaway side view of an assembly of an embodiment in accordance with aspects of the invention.

FIG. 8 is a cutaway side view of assembly 800 of an embodiment in accordance with aspects of the invention. Assembly 800 comprises assembled MESAD kit 802 and grenade munition 804. Assembled MESAD kit 802 may be the same as or similar to assembled MESAD kit 302 shown in FIG. 3 and FIG. 4. As shown in FIG. 8, assembled MESAD kit 802 comprises munition adapter 102, high explosive booster charge 104, LEEFI detonator 106, warhead initiation module 108, high voltage fireset 130, safe arm module 132, partition 138, and cable 140 as previously described. Assembled MESAD kit 802 may be used in place of a legacy prior art fuze, such as prior art fuze 700 shown in FIG. 7. Assembly 800 may be used as an assembled MESAD and munition combination as described herein.

Listing of Elements

100—miniature electronic safe arm device (MESAD) kit
102—munition adapter
104—high explosive booster charge
106—low energy exploding foil initiator (LEEFI) detonator
108—warhead initiation module (WIM)
110—male threaded portion of munition adapter 102
112—female threaded portion of munition shell 116
114—an end of munition shell 116
116—munition shell
118—channel 118 defined by housing 120
120—housing
122—opening defined by high explosive booster charge 104
124—portion of LEEFI detonator 106
126—LEEFI detonator socket 126
128—portion of LEEFI detonator socket not placed in opening 122 defined by high explosive booster charge 104
130—high voltage fireset
132—safe arm module (SAM)
134—socket of WIM 108
136—connector cable that connects to WIM 108
138—partition
140—cable that electronically connects SAM 132 to high voltage fireset 130
300—assembly of assembled MESAD kit 302 and munition shell 116
302—MESAD kit 100, as assembled
350—munition
400—Loitering munition system
402—glider
404—forward fins
406—rear fins
500—miniaturized strike payload
502—safe arm module
504—booster charge
510—miniature electronic safe arm device (MESAD) in FIG. 5
516—munition shells
520—miniaturized strike precision glide munition
522—cables
530—fireset and LEEFI detonator combination
550—munition
600—vertical take-off landing (VTOL) loitering munition kit
602—wing
604—wing
606—propeller
608—propeller
610—upright fin
612—upright fin
616—connection plate
618—connection plate
620—connection plate
622—connection plate
624—payload housing
626—payload housing
628—payload housing
630—munition
632—munition

634—munition
650—VTOL loitering munition assembly
652—electrical connector
654—fastener
656—servos
660—body
662—non-conductive connector
664—non-conductive connector
666—elevon
668—elevon
700—prior art fuze detonator
702—nose
704—body
706—magazine
800—assembly
802—assembled MESAD kit
804—grenade munition In accordance with aspects of the invention, the MESAD kit allows for re-use of 5/8-12 threaded fuze well munitions such as the M67 hand grenade. Those skilled the art having the benefit of this disclosure will recognize that the MESAD kit can be modified to allow for re-use of munitions with "thread in" fuzing as UAS payloads such as 60 mm, 81 mm, 120 mm mortar rounds, and other munitions. The MESAD can also be configured to have either a detonating or a deflagrating (pyrotechnic) output. The booster charge may be a PBXN Booster Charge.

The re-purposed munition approach disclosed herein greatly reduces the costs associated with development and qualification of a new munition for use with small UAS loitering munitions. The disclosure herein allows for modifying an existing off the shelf munition, and replacing the legacy fuze with a new (C6ISR Data Link capable) Miniature Electronic Safe Arm Device (MESAD). The MESAD, when qualified, ensures this retrofit upgrade can meet fuzing system, Weapon System Explosive Safety Review Board (WSESRB) and other safety review board criteria, by incorporating recognized and approved energetic materials and devices, such as the Low Energy Exploding Foil Initiator (LEEFI) and (if needed) MIL-STD-1316 and MIL-STD-2105 compliant booster materials.

The MESAD electronic design features and safety architecture leverage safety board established and qualified approaches and techniques. For example, the weapon system command and control (C2) data link can provide real-time weapon Safe/Arm status indicator to the user. Additional built-in safety controls include automatic Return to Safe of the weapon system (prior to the terminal phase) in the event of any UAS start up or in-flight anomalies. The munition, MESAD, and adaptor are modular and can be stored/shipped separately from the UAS. The inert transport and storage configuration of the MESAD reduces costs. The adaptor kit can be shipped and stored as hazard class 1.4. Munitions can be safely removed and stored (hazard class 1.1) separately while recharging batteries.

In accordance with aspects of the invention, the MESAD technology disclosed herein utilizes an advanced data-link activated, dispersed electronic safe and arm device (ESAD) system that can simultaneously initiate up to 8 individual fragmentation warheads strategically packaged into a UAV system.

In accordance with aspects of the invention, the MESAD technology disclosed herein is compatible utilizes and can assemble directly to off-the-shelf combat proven munitions.

In accordance with aspects of the invention, the MESAD technology disclosed herein can be utilized interchangeably with advanced customized 3D printed warheads. This allows a "common" fuze architecture in a desired size and class of weapons, to be both forward and backward compatible. This essentially standardizes the fuze for multiple munition types, providing a higher quantity demand that provides a lower unit cost economic order quantity benefit. Exemplary size and class of weapons for the MESAD technology disclosed herein include, but are not limited to Department of Defense (DoD) Groups 1 through 5:

- UAS Group 1, maximum weight 0-20 (lb) (MGTOW), nominal operating altitude of less than 1,200 AGL (ft), speed of about 100 km, representative UAS: RQ-11 Raven, WASP, and Puma;
- UAS Group 2, maximum weight 21-55 (lb) (MGTOW), nominal operating altitude of less than 3,500 AGL (ft), speed of less than 250 km, representative UAS: ScanEagle, Flexrotor, and SIC5;
- UAS Group 3, maximum weight of less than 1,320 (lb) (MGTOW), nominal operating altitude of less than FL 180 (ft), speed of less than 250 km, representative UAS: V-BAT, RQ-7B Shadow, RQ-21 Blackjack, Navmar RQ-23 Tigershark, Arcturus-UAV Jump 20, Arcturus T-20,SIC25, Resolute ISR Resolute Eagle, and Vanilla;
- UAS Group 4, maximum weight of greater than 1,320 (lb) (MGTOW), nominal operating altitude of less than FL 180 (ft), any airspeed, representative UAS: MQ-8B Fire Scout, MQ-1A/B Predator, and MQ-1C Gray Eagle; and
- UAS Group 5, maximum weight of greater than 1,320 (lb) (MGTOW), nominal operating altitude of greater than FL 180 (ft), any airspeed, representative UAS: MQ-9 Reaper, RQ-4 Global Hawk, and MQ-4C Triton.

Preferably, the size and class of weapons for the MESAD technology disclosed herein is selected from the group consisting of DoD UAS Group 2 and DoD UAS Group 3, DoD UAS Group 4, and DoD UAS Group 5.

In accordance with aspects of this disclosure, the MESAD is a "distributed" architecture. As such, the Safe and Arm Module (SAM) and Warhead Initiator Module (WIM) fireset functionality is partitioned on separate circuit cards, which are then connected together with a reliable board-to-board flex cable. In an embodiment, the architecture is packaged into an airframe, typically mounted in the missile payload.

In accordance with aspects of this disclosure, the SAM is separated from the multiple WIM fireset(s) in the missile. The SAM contains all of the electronics that control the electronic safety and arm function (ESAF) up to the time the single or multiple firesets are armed with high voltage. Optionally, a precursor fireset can be utilized to detonate a precursor warhead on impact of the missile to its target while the main charge fireset can be designed to detonate its warhead at a preset delay time from the initial precursor detonation.

In accordance with aspects of the invention, the MESAD may have remotely selectable fuze setting options. These fuze setting options allow for an off-the-shelf indirect fire "dumb" mortar to be converted into a "smart" air launched direct attack munition, incorporating advanced state-of-the-art fuze safe technology.

In accordance with aspects of the invention, the MESAD offers selectable operating modes, including but not limited to (1) height of burst (HOB), (2) point detonation (PD), and (3) delay mode (DM), and combinations thereof. The MESAD may be configured to receive a trigger signal from a precision HOB sensor. Height of burst may be user selectable remotely, e.g., from a tablet, in range, e.g., zero (0) to fifteen (15) meters.

In accordance with aspects of the invention, the MESAD may have a fireset that incorporates a micro switch detecting impact and provide a trigger signal for instant Point Detonation (PD).

In accordance with aspects of the invention, the MESAD may have a fireset that can survive impact shock and operate within a pre-programmed user selectable delay range, e.g., between 1 and 100 milliseconds, in 1 millisecond increments.

Multiple variations of the aspects and features of the invention are possible and considered to be within the scope of the invention. For example, the size, shape, and materials of components disclosed herein may be varied. As a consequence, the invention is to be limited only by the following claims and equivalents thereof.

What is claimed is:

1. A miniature electronic safe arm device (MESAD) kit comprising:

a unitary T-shape munition adapter, wherein the unitary T-shape munition adapter is configured to mate with a female portion of a munition shell, wherein the unitary T-shape munition adapter has a bolt portion and a T-portion, wherein the T-portion is perpendicular to the bolt portion, wherein the bolt portion has integral threads thereon configured to mate directly with integral threads of the female portion of the munition shell;

a high explosive booster charge;

a low energy exploding foil initiator (LEEFI) detonator; and a warhead initiation module (WIM).

2. The MESAD kit of claim 1, wherein the munition adapter comprises a housing, wherein the housing defines a channel.

3. The MESAD kit of claim 2, wherein the channel is configured to receive the high explosive booster charge.

4. The MEAD kit of claim 3, wherein the high explosive booster charge defines an opening configured to receive at least a portion of the LEEFI detonator.

5. The MESAD kit of claim 1, wherein the WIM comprises a high voltage fireset and safe arm module (SAM).

6. The MESAD kit of claim 1, wherein the WIM comprises a socket configured to receive a connector cable, wherein the connector cable is configured to provide electrical power and communications to and from the WIM.

7. The MESAD kit of claim 1, further comprising a connector cable, wherein the connector cable is configured to provide electrical power and communications to and from the WIM.

8. A system comprising:

a munition; and a miniature electronic safe arm device (MESAD), the MESAD comprising a unitary T-shape munition adapter, wherein the unitary T-shape munition adapter is configured to mate with a female portion of a munition shell, wherein the unitary T-shape munition adapter has a bolt portion and a T-portion, wherein the T-portion is perpendicular to the bolt portion, wherein the bolt portion has integral threads thereon configured to mate directly with integral threads of the female portion of the munition shell;

a high explosive booster charge;

a low energy exploding foil initiator (LEEFI) detonator; and a warhead initiation module (WIM);

wherein the MESAD is connected to the munition.

9. The system of claim 8, wherein the munition adapter comprises a housing, wherein the housing defines a channel.

10. The system of claim 9, wherein the channel is configured to receive the high explosive booster charge.

11. The system of claim 10, wherein the high explosive booster charge defines an opening configured to receive at least a portion of the LEEFI detonator.

12. The system of claim 8, wherein the WIM a high voltage fireset and safe arm module (SAM).

13. The system of claim 8, wherein the WIM comprises a socket configured to receive a connector cable, wherein the connector cable is configured to provide electrical power and communications to and from the WIM.

14. The system of claim 8, further comprising a connector cable, wherein the connector cable is configured to provide electrical power and communications to and from the WIM.

15. The system of claim 8, wherein the munition is a grenade munition.

16. The system of claim 8, wherein the system is a loitering munition system.

17. The system of claim 16, wherein the system comprises a plurality of high voltage firesets and LEEFI detonators, wherein each combination of high voltage firesets and LEEFI detonators is connected to one of a plurality of munition shells of a miniaturized strike payload and to one of a plurality of high explosive booster charges, and a safe arm module of the WIM is electronically connected to each combination of high voltage firesets and LEEFI detonators.

18. The system of claim 17, wherein the system is placed in a miniaturized strike glide munition.

19. A loitering munition kit comprising the MESAD kit of claim 1, the loitering munition kit further comprising at least one connection plate, a body, at least two wings, at least two propellers, and at least two fins, wherein each fin is configured to be perpendicular to each wing when connected to a corresponding wing, wherein the body is configured to connect to the at least one connection plate, wherein each wing comprises at least one propeller, wherein each wing is configured to connect to the body, wherein the at least one connection plate is configured to connect to at least one of a variety of payload housings, wherein each payload housing is configured to house a munition.

20. The loitering munition kit of claim 19, wherein the at least one connection plate is configured to house the MESAD kit as assembled.

21. The loitering munition kit of claim 19, wherein the body is configured to house the MESAD kit as assembled.

22. The loitering munition kit of claim 19, wherein the kit is a vertical take-off landing (VTOL) loitering munition kit.

* * * * *